United States Patent [19]

Klapdor et al.

[11] 4,003,211

[45] Jan. 18, 1977

[54] METHODS AND APPARATUS FOR CONSTRUCTING TUNNELS

[75] Inventors: Heinrich Klapdor, Hamburg; Armin Löbbe, Bergkaman-Oberaden, both of Germany

[73] Assignee: Gewerkschaft Eisenhutte Westfalia, Westphalia, Germany

[22] Filed: Oct. 14, 1975

[21] Appl. No.: 622,575

[30] Foreign Application Priority Data

Dec. 19, 1974 Germany ..... 2460033

[52] U.S. Cl. ..... 61/84; 61/42; 52/310

[51] Int. Cl.[2] ..... E01G 5/08; E01G 5/16

[58] Field of Search ..... 61/84, 85, 42, 43, 45, 61/41; 52/310

[56] References Cited

UNITED STATES PATENTS

| | | | |
|---|---|---|---|
| 1,286,666 | 12/1918 | Layne | 61/10 X |
| 3,379,024 | 4/1968 | Wohlmeyer | 61/85 |
| 3,410,098 | 11/1968 | Winberg | 61/85 |
| 3,561,223 | 2/1971 | Tabor | 61/85 |
| 3,611,735 | 10/1971 | Daczko | 61/53.64 |
| 3,827,244 | 8/1974 | Wolbrohl | 61/84 |
| 3,834,170 | 9/1974 | Lobbe et al. | 61/84 |

*Primary Examiner*—Dennis L. Taylor
*Attorney, Agent, or Firm*—Sughrue, Rothwell, Mion, Zinn & Macpeak

[57] ABSTRACT

In a tunnel driving apparatus which employs hydraulic rams for advancing a shield in the direction of tunnel advancement, a thrust ring is used as a support for the rams. Lining sections are installed at the rear side of the thrust ring as the latter is shifted up. These lining sections are each spaced from the exposed tunnel wall when installed to receive fluid concrete used to form a tunnel lining. The thrust ring defines chambers, one of which has filter means which faces the concrete reception space and contacts the concrete therein. Water is withdrawn from the concrete by suction created by reducing the pressure in the chambers and the other of the chambers is used to collect the water. Inflatable packings are used to seal off the concrete reception space and can be deflated when the thrust ring is shifted up.

16 Claims, 3 Drawing Figures

METHODS AND APPARATUS FOR CONSTRUCTING TUNNELS

BACKGROUND TO THE INVENTION

The present invention relates in general to methods and apparatus for constructing tunnels.

It is known to produce a tunnel with the aid of a shield advanced by rams and to provide a support lining for the tunnel wall by introducing fluid concrete behind the shield. In the related U.S. Pat. Nos. 3,834,170 and 3,889,480, assigned to the same assignee as the present invention, there is generally disclosed an apparatus of the aforementioned type wherein water is driven out from the fluid concrete through filters when the rams are operated to advance the shield by making the rams compress the concrete. In some cases it may be more desirable to expel water from the concrete prior to advancement of the shield, i.e., independently of the operation of the rams and to effect better control of the water extracting operation.

With this in mind the present invention seeks to provide an improved apparatus and methods.

SUMMARY OF THE INVENTION

According to one aspect of the invention there is provided a method of producing an in-situ support lining for a tunnel by installing a lining section spaced from the wall of the tunnel to be lined, introducing fluid concrete into the space between the lining section and the tunnel wall and withdrawing water from the concrete through filter means contacting the concrete by creating suction acting on the filter means.

In another aspect the invention provides a method of constructing a tunnel by utilizing hydraulic rams to advance a shield and comprising installing a lining section generally rearwardly of the shield relative to the direction of advancement and spaced from the tunnel wall introducing concrete into the space between the lining section and withdrawing water from the concrete through filter means contacting the concrete by creating a suction acting on the filter means.

Further according to the invention there is provided an apparatus for use in the construction of tunnels; said apparatus comprising a plurality of hydraulic rams used to advance a shield, filter means disposed to at least partly delimit a space for receiving concrete used to form a lining rearwardly of the shield relative to the direction of advancement, and a chamber for receiving water withdrawn from the concrete through the filter means by suction.

In general, the invention forces water out from the concrete by creating a low or reduced pressure on one side of the filter means and conveniently in a chamber bounded by the filter means. This chamber can be made part of a thrust ring which serves as an abutment for the rams. Preferably this chamber extends completely around the ring and the tunnel and may be defined between rearwardly extending flanges of the ring.

In accordance with another preferred feature of the invention tubular packings capable of being inflated or deflated are used to seal off the concrete-reception space. These packings would be inflated while the water is being sucked out from the concrete and deflated when the thrust ring is advanced up. Normally, the thrust ring would be shifted up by a distance sufficient to accommodate the next lining section. The concrete can be introduced into the reception space via bores in the lining section which is installed so that the ring bears on the lining sections, disposed end-to-end, when the rams advance the shield.

The removal of water from the concrete can be controlled by the reduction of pressure acting on the filter means. This is especially advantageous since the removal of water from the concrete can thus be adjusted so that it is effected over a certain zone which zone will not collapse when the ring is shifted. This zone of concrete is subsequently moistened both by the water in the remainder of the concrete and by the water in the next batch of concrete. This, in turn, ensures satisfactory homogeneity at the junctures between the batches of concrete. The overall progress of tunnel construction can hence take place at optimum speed.

In accordance with a constructional embodiment of the invention a second chamber is provided, the second chamber being in communication with the first chamber whereby the pressure in the second chamber can be reduced to draw water through the filter means and the first chamber and into the second chamber. This second chamber, which acts as a separating chamber receiving the water, can be defined by a structural part of the thrust ring and at the floor region of the thrust ring. Preferably the second chamber has a drain outlet for draining off the water and the structural part of the ring is located between two of the shifting rams.

A pipe may provide communication between the chamber and may serve to discharge the water, passed around a U-tube section, permitting visual inspection of the water flow, into the second chamber. A further pipe and connector may serve to connect the second chamber to a pump for producing the reduced pressure therewith. The inflation and deflation of the packings may be achieved with this pump or with some other unit.

It is possible to subject the concrete to additional suction if desired by providing perforations in the wall of the lining sections and by providing appropriate connections to the pump or another pump. These perforations would be provided over part of its lining section adjacent the filter means.

In another broader aspect the invention also provides an apparatus for use in the construction of tunnels; said apparatus comprising a plurality of fluid rams, a shield connected for movement upon operation of said rams in the direction of tunnel advancement, means, including filter means, for defining a space for receiving concrete used to form a tunnel lining rearwardly of the shield relative to the direction of tunnel advancement, and means for creating a lowered pressure on the filter means whereby to withdraw water from the concrete and through the filter means by suction.

This invention may be understood more readily and various other features of the invention may become apparent from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
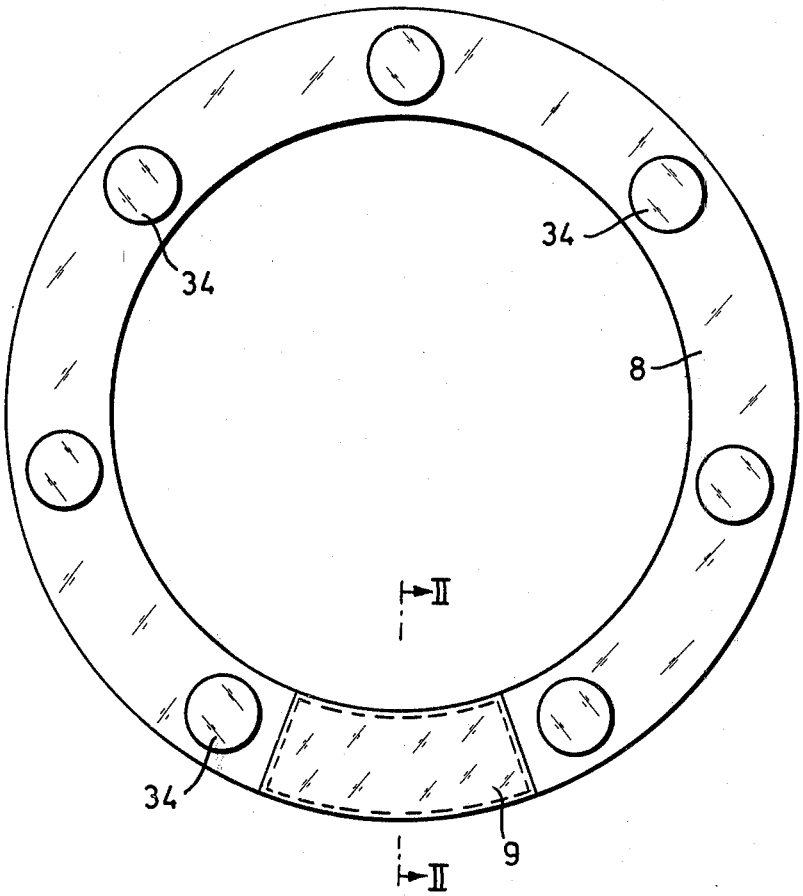
FIG. 1 is an end view of the thrust ring of a tunnel driving apparatus made in accordance with the invention.

As shown in FIG. 1, a tunnel driving apparatus made in accordance with the invention has an abutment-forming means in the form of a thrust ring denoted 8. A series of hydraulic rams represented schematically at 34, are distributed around the ring 8 and connected thereto. Although not illustrated in detail the apparatus would in known manner employ at least one forward shield, which may be composed of a series of elongate planks arranged side-by-side or a continuous cylindrical structure, and a cutting device which serves to excavate material from a working face. The forward shield serves to support the tunnel wall over the forward region and from time to time the rams 34 are operated to advance the forward shield and preferably also the cutting device in the direction of tunnel driving. The rams 8 press on the ring 8 which thus acts as an abutment and the ring 8 can be drawn up by retracting the rams 34. Rearwardly of the ring 8 relative to the forward shield and the working face a permanent lining is formed for supporting the tunnel wall. To this end, a series of pre-fabricated lining sections would be installed end-to-end and the space between these lining sections and the wall would be filled with concrete in successive stages. To facilitate the concreting operation the ring 8 is constructed as described hereinafter.

Figure 2:
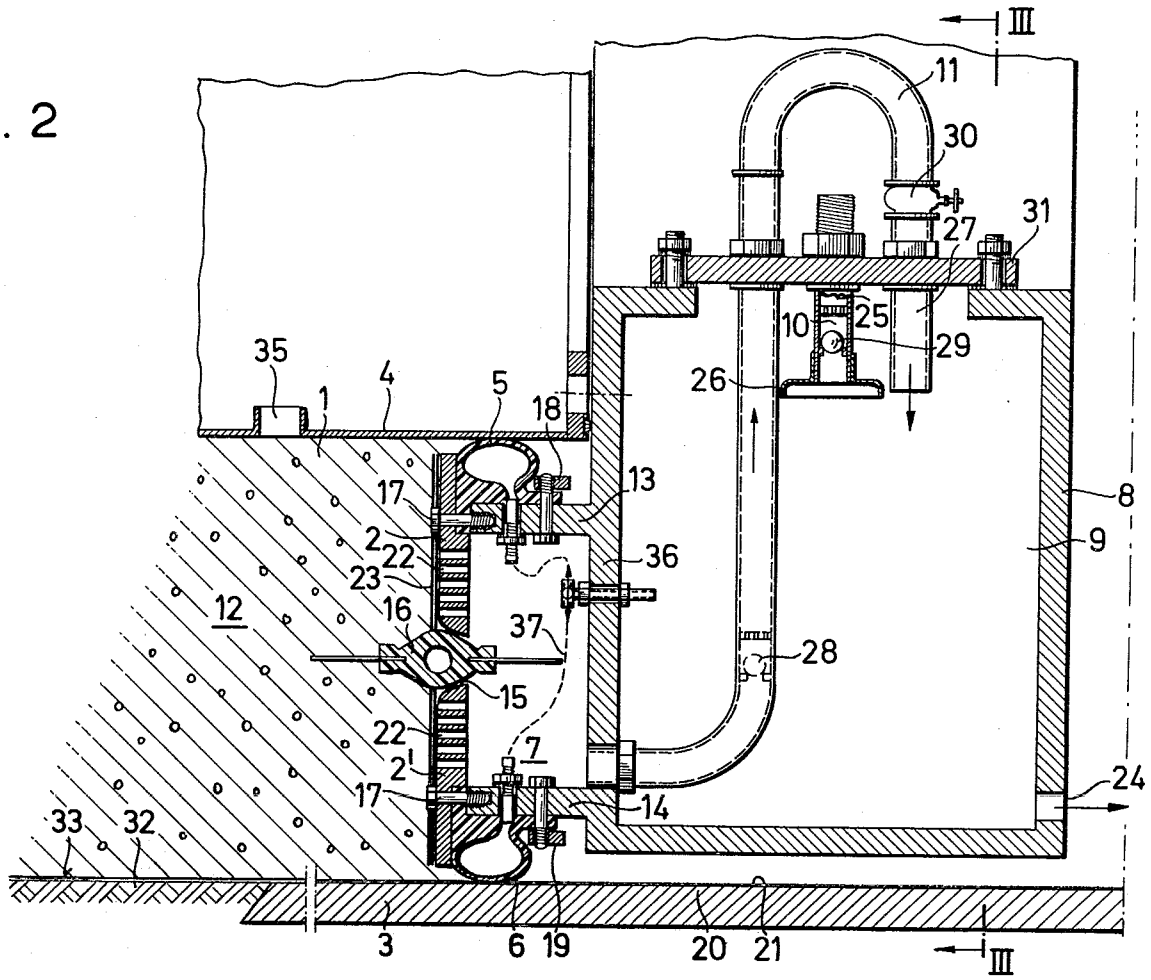
FIG. 2 is a sectional side view of a lowerpart of the thrust ring, the view being taken along the line II—II of FIG. 1 and on a somewhat enlarged scale.
Figure 3:
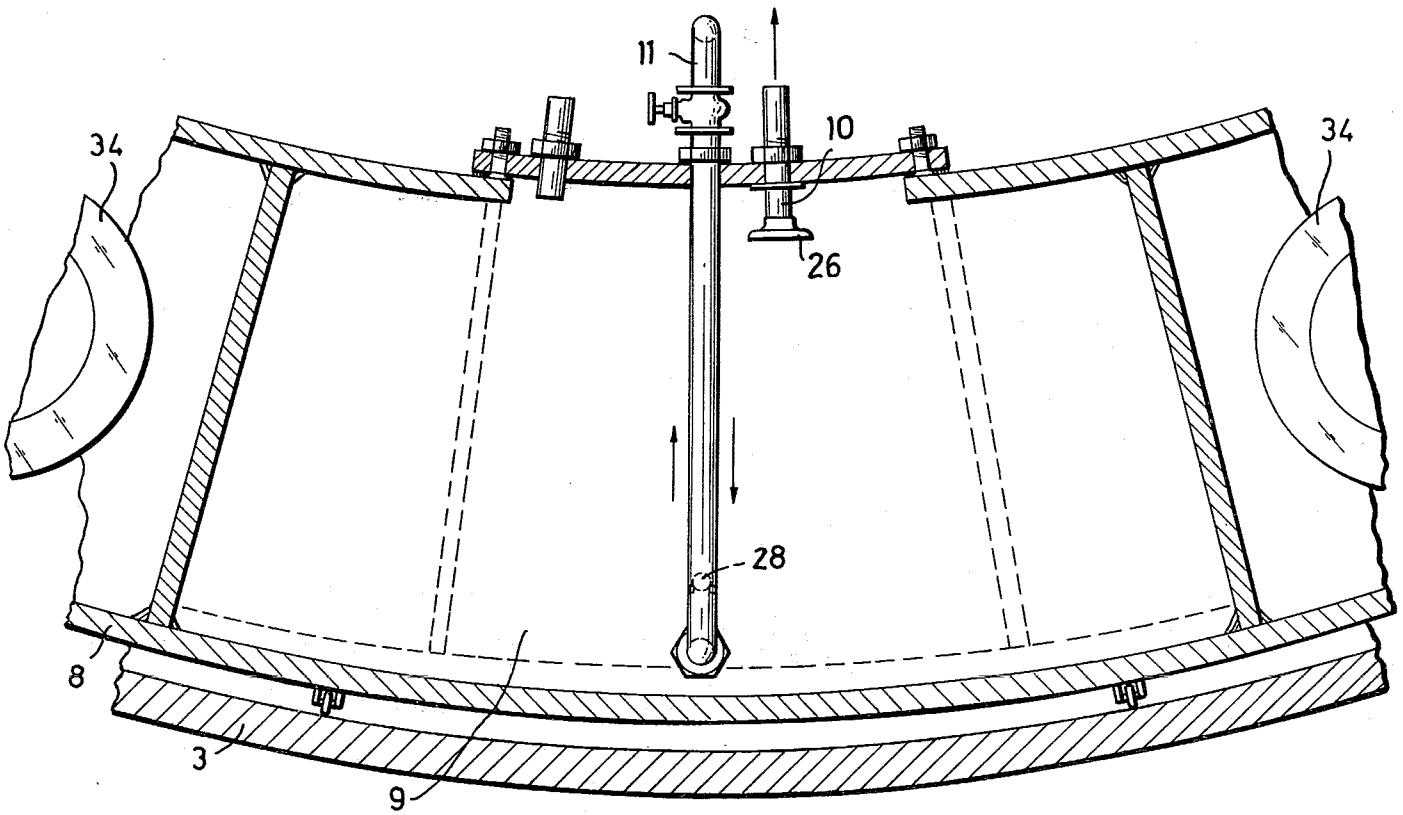
FIG. 3 is a sectional end view of the lowerpart of the thrust ring assembly, taken along lines III—III of FIG. 2.

Referring now to FIGS. 2 and 3, the front side of the ring 8 at the right hand side of FIG. 2 faces the working face and the rear side of the ring 8 at the left hand side of FIG. 2 faces the rear lining. One of the lining sections, denoted 4 is disposed at the rear side of the ring 8 to engage on the latter. Fluid concrete 1, can be introduced via bores 35 and fittings on the inside of the section 4 into the annular space 12 between the tunnel wall 32 and the outside of the section 4. A thin plastics film or membrane 33 is preferably arranged on the tunnel wall 32 to separate the concrete 1 from the wall 32 and to prevent intermixing and possible weakening of the concrete. A rear part of the forward shield denoted 3 projects beyond the rear side of the ring 8 and guide rollers or the like (see FIG. 3) can be provided to guide the ring 8 on the shield 3. Agitating devices not shown can be used to aid the filling and settling of the fluid concrete 1 in the space 12. The rear axial end of the space 12 is of course, de-limited by the concrete introduced previously while the front axial end of the space 12 is de-limited by filter means extending around the tunnel and permitting the passage of liquid from the space 12 into a first hermetically sealed chamber 7.

This first chamber 7 is defined by flanges 13, 14 projecting rearwardly from the rear side face of the ring 8. A structure forming the aforementioned filter means is provided opposite the wall portion 36 and is detachably secured to the flanges 13, 14 with the aid of screws 17. The structure forming the filter means is here composed of filter plates 2, 2′ provided with borings 22 and each supplemented by a two-layer filter gauge 23 on the rear side facing the space 12. A flexible separating piece (not shown) is normally disposed in the gap 15 between the plates 2, 2′ and has a smooth profile to the plates 2, 2′. The gauze 23 and borings 22 are designed to permit the flow of liquid from the concrete into the chamber 7 while preventing the solid constituents from passing therethrough. The separating piece in the gap 15 is detachable and when it is desired to provide a separable joint between successive batches of concrete the piece is removed and replaced by a jointing ring or band 16 as illustrated. The end face of the concrete is then filled with one half of the jointing ring 16. The adjacent abutting areas of the concrete would be treated with a substance preventing mixing and adhesion of the concrete so that the next batch of concrete sets over the jointing ring 16 and is separable from the previous batch of concrete.

Tubular seals or packings 5, 6 are secured to the flanges 13, 14 with the aid of the fixing screws 17 and with the aid of additional clamping devices 18 as shown. The packings 5, 6 can be easily detached and replaced when desired. The packing 5 can engage on the outside of the lining section 4 and the packing 6 can engage on a thin plastics film or membrane 21 at the inner surface 20 of the shield 3. The film 21 enables the packing 6 to slide more easily and reduces wear. The packings 5, 6 are designed to be inflated by the admission of compressed air at about 4 atmospheres excess pressure or deflated by connection with a reduced pressure below atmospheric. To facilitate this, the packings 5, 6 have their interiors connected to nozzles mounted in the flanges 13, 14 and these nozzles in turn are connected with hoses or conduits denoted by dotted lines to a further connector mounted on the wall portion 36.

The wall portion 36 and the flanges 13, 14 are formed integrally with a casing forming a structural part of the floor zone of the ring 8 (FIG. 3) and defining a second hermetically sealed chamber 9. The chamber 9 has a detachable cover 31 located at its radially innermost or uppermost side on which is mounted various connectors for pipes or conduits or the like. One connector 25 mounts a short pipe 10 extending into the chamber 9. A detachable filter 26 is attached to the inner end of the pipe 10 and a non-return ball valve 29 is accommodated in the pipe 10. The connector 25 serves for connecting the pipe 10, and hence the interior of the chamber 9, to a pump (not shown) whereby the pressure in the chamber 9 can be reduced. The connector in the wall portion 36, which establishes connection with the interior of packings 5, 6 can be connected by a hose to another connector (not shown) mounted on the cover 31 and this other connector can be selectively connected to a high pressure or low pressure source, conveniently provided by the pump, to enable the inflation or deflation of the packings 5, 6. Further connectors on the cover 31 respectively mount a short pipe section 27 open to the interior of the chamber 9 and a main pipe which incorporates a non-return ball valve 28 leading directly through a connector on the wall portion 36 to the interior of the chamber 7. A U-tube 11 with at least a transparent inspection portion, conveniently made from glass, extends exteriorly of the chamber 9 and interconnects the pipe section 27 and the main pipe leading to the chamber 7. A shut-off valve 30 is incorporated in the U-tube 11 and enables selective connection between the chambers 9, 7 whereby a partial vacuum can be maintained when the pump is inoperative. A drain outlet 24, normally covered by a residual level of water in the chamber 9, e.g., about 30 cms, permits the outflow of excess water therefrom.

During use of the apparatus and after the lining section 4 has been installed the rams 34 can be operated to urge the forward shield towards the working face and the reactive forces of the rams 8 are transmitted to the ring 8 and the rear lining via the section 4 abutting the ring 8. Concrete 1, is now introduced into the space 12 prior to advancement of the ring 8. At this stage, the packings 5, 6 are inflated as shown in FIG. 2 to seal off the space 12. The pump then serves to produce a low pressure in the chamber 9 and hence in the chamber 7. The suction thus created causes water to be drawn from the concrete 1 and through the filter means (2,2',23) to pass through the pipe system, incorporating the U-tube 11, to fall back into the chamber 9. Excess liquid is drained off via the outlet 24 and the chamber 9 thus serves as a separating chamber for air and water. The removal of water from the concrete 1 generally reduces the hardening time in known manner and prevents the concrete from slipping forwards when the thrust ring 8 is moved up. At the appropriate stage the low pressure in the chambers 7, 9 is relieved and the packings 5, 6 are deflated to permit the ring 8 to be shifted up. Normally the ring 8 would be shifted by a distance commensurate with the length of one of the lining sections 4. Thereafter, the next lining section 4 is installed and the sequence repeated with the introduction of a fresh batch of concrete. This operation would of course be synchronized with the progress of excavation performed and the forward end of the tunnel in front of the ring 8. The various connectors can allow the external hoses and the pump to be disconnected if desired during shifting. By controlling the pressure acting on the filter means the amount of water actually removed can be controlled. It is desirable to remove the water over the front end zone of the concrete usually a region extending over about 30 c.m. This dried out zone will be re-moistened by the water in the rest of the concrete and also by the water in the next batch of concrete introduced when the ring 8 has been shifted up. Thus, the water is re-distributed throughout the concrete and the junctures between the batches of concrete will be homogeneous.

We claim:

1. A method of constructing a tunnel comprising operating fluid rams to advance a shield in a manner known per se;

installing a pre-fabricated lining section generally rearwardly of the shield relative to the direction of advancement of the shield, said lining section being spaced from the wall of the tunnel to define a space bounded by filter means;

introducing fluid concrete into said space; and withdrawing water from the concrete through the filter means by suction acting on the filter means, wherein a thrust ring is utilized as an abutment for the rams and the thrust ring at least partly defines a chamber on the side of the filter means remote from the concrete, the pressure in said chamber being reduced to draw the water through the filter means and into said chamber, and wherein the rams are operated to shift the thrust ring in the direction of advancement after the water has been withdrawn and prior to advancement of the shield.

2. A method according to claim 2, and further comprising inflating tubular packings to seal off the concrete-reception space and deflating said packings when the thrust ring is to be shifted.

3. A method according to claim 2, further comprising passing the water withdrawn from the concrete from the first chamber into a second chamber defined by the thrust ring and from whence the water can be separated and drained off.

4. A method according to claim 3, wherein the first and second chambers communicate and a low pressure is created in the second chamber to draw the water through the filter means and the first chamber and into the second chamber.

5. An apparatus for use in the construction of tunnels; said apparatus comprising a plurality of fluid rams, a shield connected for movement upon operaton of said rams in the direction of tunnel advancement, means, including filter means, for defining a space for receiving concrete used to form a tunnel lining rearwardly of the shield relative to the direction of tunnel advancement, and means for creating a lowered pressure on the filter means by suction, wherein a thrust ring is provided as an abutment for the rams and is shiftable in the direction of advancement by operation of the rams to follow up the shield, the thrust ring at least partly defining a chamber for receiving water withdrawn from the filter means and constituting part of said means for creating a lowered pressure on the filter means, and the filter means is mounted to the chamber-defining part of the thrust ring so as to face said chamber.

6. An apparatus according to claim 5, wherein the filter means extends around the tunnel.

7. An apparatus according to claim 5, wherein the means defining the concrete reception space partly comprises lining sections arranged end-to-end and having bores for permitting the introduction of concrete therethrough and wherein the thrust ring engages on the last-installed lining section.

8. An apparatus according to claim 5, and further comprising tubular packings arranged adjacent the filter means, the packings being selectively inflatable to seal off the concrete.

9. An apparatus according to claim 5, wherein there are provided replaceable tubular packings mounted to the thrust ring adjacent the filter means, the packings being inflatable to seal off the concrete-reception space from the forward region of the tunnel during use of the apparatus and deflatable when the thrust ring is shifted in the direction of advancement.

10. An apparatus according to claim 5, wherein a second chamber is provided, the second chamber being in communication with the first chamber whereby the pressure in the second chamber can be reduced to draw water through the filter means and the first chamber and into the second chamber.

11. An apparatus according to claim 10, wherein the second chamber is defined by a structural part of the thrust ring.

12. An apparatus according to claim 10, wherein the second chamber has a drain outlet for permitting the water to be removed.

13. An apparatus according to claim 10, wherein communication between the first and second chambers is by way of a pipe, the second chamber is closed with a detachable cover and a connector and a further pipe are mounted to the cover to enable the second chamber to be connected to a pump operable to reduce the pressure in the first and second chambers.

14. An apparatus according to claim 13, wherein the first-mentioned pipe includes a U-tube extending through the cover, the U-tube at least including a transparent inspection portion and adjoining an open ended pipe section permitting water to discharge into the second chamber after passing through the U-tube.

15. An apparatus according to claim 14, wherein the U-tube incorporates a shut off valve and the first-mentioned and further pipes incorporate non-return valves.

16. An apparatus according to claim 13, wherein a filter is provided at the inner end of the further pipe within the second chamber.

* * * * *